US009188944B2

(12) United States Patent
Park et al.

(10) Patent No.: US 9,188,944 B2
(45) Date of Patent: Nov. 17, 2015

(54) IMAGE FORMING APPARATUS

(75) Inventors: Jeong-yeon Park, Hwaseong-si (KR); Byung-sun Ahn, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 163 days.

(21) Appl. No.: 13/564,988

(22) Filed: Aug. 2, 2012

(65) Prior Publication Data

US 2013/0121719 A1 May 16, 2013

(30) Foreign Application Priority Data

Nov. 10, 2011 (KR) ..... 10-2011-0117166

(51) Int. Cl.
*G03G 21/16* (2006.01)

(52) U.S. Cl.
CPC ..... *G03G 21/1652* (2013.01); *G03G 2221/166* (2013.01); *G03G 2221/1684* (2013.01); *G03G 2221/1869* (2013.01)

(58) Field of Classification Search
CPC ..... G03G 2221/166; G03G 21/1867; G03G 21/1871; G03G 2221/183
USPC ..... 399/90, 110, 88
See application file for complete search history.

(56) References Cited

U.S. PATENT DOCUMENTS 7,773,905 B2 8/2010 Kuruma
8,238,786 B2 8/2012 Yamaguchi et al.
2008/0159773 A1 7/2008 Murayama et al.
2009/0245861 A1* 10/2009 Eom ..... 399/119
2010/0080619 A1 4/2010 Kawanami
2011/0091222 A1* 4/2011 Kim et al. ..... 399/9
2013/0243470 A1 9/2013 Maeda et al.

FOREIGN PATENT DOCUMENTS

JP 2008-165025 7/2008
JP 2008-276117 11/2008
JP 2010-102283 5/2010
JP 2010-102326 5/2010
JP 2010-102355 5/2010
JP 2010217261 A * 9/2010

OTHER PUBLICATIONS

Sato et al. (JP 2010-217261 A) Sep. 2010, JPO Computer Translation.*

* cited by examiner

*Primary Examiner* — Erika J Villaluna
(74) *Attorney, Agent, or Firm* — Staas & Halsey LLP

(57) ABSTRACT

An image forming apparatus in which developers are detachably coupled to a main body. The image forming apparatus includes: a developer mount member on which the developers are mounted and that is attachable to and detachable from the main body; an input contact member disposed on the developers; a power supply unit that is provided in the main body; an output contact member that is disposed in the main body to face a front end of the developer mount member in a mount direction in which the developer mount member is mounted and is electrically connected to the power supply; and intermediate contact members disposed on the front end of the developer mount member in the mount direction and are electrically connected to a respective input contact member, and electrically contacts the output contact member as the developer mount member is mounted.

9 Claims, 10 Drawing Sheets

IMAGE FORMING APPARATUS

CROSS-REFERENCE TO RELATED APPLICATIONS

This application claims priority and the benefit of Korean Patent Application No. 10-2011-0117166, filed on Nov. 10, 2011, in the Korean Intellectual Property Office, the disclosure of which is incorporated herein in its entirety by reference.

BACKGROUND OF THE INVENTION

1. Field of the Invention

The present inventive concept relates to an image forming apparatus in which a developer member including a plurality of developers is detachably coupled to a main body.

2. Description of the Related Art

An image forming apparatus, particularly, an electrophotographic image forming apparatus, forms an electrostatic latent image on a surface of a photosensitive member by emitting light modulated to correspond to image information to the photosensitive member, develops the electrostatic latent image into a visible toner image by supplying toner to the electrostatic latent image, and prints an image on a recording medium by transferring and fixing the toner image to the recording medium.

The photosensitive member and the toner may be provided in a cartridge, which is defined as a 'developer'. Herein, the use of the term 'developer' refers to a cartridge in which a photosensitive member and toner are contained. Rollers such as a charging roller and a developing roller are disposed on the developer, and bias voltages are applied to the rollers. An electrical contact member for electrically connecting the rollers to a power supply device disposed in a main body of the image forming apparatus is provided.

In particular, an image forming apparatus designed for a user to more easily attach or detach a developer and repair the developer has recently been developed. In such an image forming apparatus, at least one developer may more easily be attached or detached by mounting the developer on a developer mount member, and pushing the developer mount member into a main body or separating the developer mount member from the main body.

If a developer is directly mounted on a main body without using a developer mount member, it is not difficult to manufacture an electrical contact member for applying a voltage to the developer. However, if a developer is mounted on a developer mount member and the developer mount member is coupled to a main body, an electrical contact member has to be connected to the main body through the developer mount member.

Examples of a method of electrically connecting a developer and a main body (specifically, a power supply device) include a method of connecting a developer and a main body by using an intermediate member and a method of directly connecting a developer and a main body.

A conventional method of connecting a developer and a main body by using an intermediate member has problems in that since the intermediate member is disposed in a direction perpendicular to a direction in which a developer mount member is withdrawn, a contact force is reduced, and since a structure for extricating the intermediate member in order to prevent damage to the intermediate member when the developer mount member is withdrawn or mounted is required, the number of parts is increased.

Also, a conventional method of directly connecting a developer and a main body has the following problems. It is necessary to prevent damage to an output contact member for applying a bias voltage to the developer due to a developer mount member or the developer when the developer mount member is withdrawn or mounted. To this end, since an interlocking member that interlocks with a door portion and extricates the output contact member when the door portion opens is required, many parts such as a link member are required. Also, since a user may be inconvenienced using the door portion because of the link member that interlocks with the door portion, user convenience may be reduced.

SUMMARY OF THE INVENTION

The present inventive concept provides an image forming apparatus that may minimize the number of parts used to electrically connect a developer and a main body and may increase an electrical contact force.

The present inventive concept also provides an image forming apparatus that may reduce user inconvenience due to opening or closing a door portion by preventing damage to an electrical contact member when a developer mount member is withdrawn or mounted without using an additional interlocking member.

Additional features and utilities of the present general inventive concept will be set forth in part in the description which follows and, in part, will be obvious from the description, or may be learned by practice of the general inventive concept.

The present inventive concept provides an image forming apparatus in which a developer is detachably coupled to a main body, the image forming apparatus including: a developer mount member on which the developer is mounted and that is attachable to and detachable from the main body; an input contact member that is disposed on the developer; a power supply unit that is provided in the main body; an output contact member that is disposed in the main body to face a front end of the developer mount member in a mount direction in which the developer mount member is mounted and is electrically connected to the power supply; and an intermediate contact member that is disposed on the front end of the developer mount member in the mount direction and is electrically connected to the input contact member, and electrically contacts or does not contact the output contact member as the developer mount member is mounted or withdrawn.

The intermediate contact member may include: a first contact member that is disposed on the front end of the developer mount member in the mount direction and directly contacts the output contact member when the developer mount member is mounted on the main body; and a second contact member that electrically connects the first contact member and the input contact member.

The mount direction may be parallel to a delivery direction in which a recording medium is delivered. The input contact member may be disposed at a side of the developer that is disposed in a direction intersecting the mount direction.

The mount direction may perpendicularly intersect a delivery direction in which a recording medium is delivered. The input contact member may be disposed at a side of the developer that is disposed in a direction parallel to the mount direction.

The mount direction may perpendicularly intersect a delivery direction in which a recording medium is delivered, the input contact member may be disposed at a side of the developer that is disposed in a direction parallel to the mount direction, and the intermediate contact member may be integrally formed with the input contact member.

The image forming apparatus may further include a door portion that is disposed on the main body and opens or closes an opening through which the developer mount member enters or exits.

The image forming apparatus may further include a guide member that guides a recording medium passing between the door portion and the developer mount member.

The present inventive concept also provides an image forming apparatus including: a developer; a main body that comprises a door portion for opening or closing an opening; a developer mount member on which the developer is mounted and that is attachable to and detachable from the main body through the opening; an input contact member that is disposed on the developer; a power supply unit that is provided in the main body; an output contact member that is disposed in the door portion to face a rear end of developer mount member in a mount direction in which the developer mount member is mounted and is electrically connected to the power supply unit; and an intermediate contact member that is disposed at the rear end of the developer mount member in a mount direction in which the developer mount member is mounted and is electrically connected to the input contact member, and electrically contacts or does not contact the output contact member as the door portion opens or closes.

The intermediate contact member may include: a first contact member that is disposed at the rear end of the developer mount member in the mount direction and directly contacts the output contact member when the door portion closes; and a second contact member that electrically connects the first contact member and the input contact member.

The mount direction may be parallel to a delivery direction in which a recording medium is delivered. The input contact member may be disposed at a side of the developer that is disposed in a direction intersecting the mount direction.

The mount direction may perpendicularly intersect a delivery direction in which a recording medium is delivered. The input contact member may be disposed at a side of the developer that is disposed in a direction parallel to the mount direction.

The mount direction may perpendicularly intersect a delivery direction in which a recording medium is delivered, the input contact member may be disposed at a side of the developer that is disposed in a direction parallel to the mount direction, and the intermediate contact member may be integrally formed with the input contact member.

The intermediate contact member may include an elastic material.

The first contact member may include an elastic material.

The present inventive concept also provides an image forming apparatus, comprising: a main body; a plurality of developers; a detachable developer mount member to receive the developers therein and attachably mountable within the main body through an opening therein; and an electrical contact assembly to transfer power received in the main body to each of the developers when the developer mount member is fully attached in the main body.

In an embodiment, the electrical contact assembly may include: an input contact member formed on at least one side of each developer; an intermediate contact member disposed on the developer mount member and electrically connected to the input contact members; and an output contact member disposed within the main body to electrically contact the intermediate contact member when the detachable developer mount member becomes fully attached in the main body.

In an embodiment, the intermediate contact member is disposed on a front end of the detachable developer mount member in the mounting direction and the output contact member is disposed within the main body at an opposite end with respect to the opening such that when the detachable developer mount member becomes fully mounted within the main body through the opening, the intermediate contact member and the output contact member make an electrical contact.

In an embodiment, the image forming apparatus may further include a door portion to open and close the opening in the main body and including a guide disposed thereon to guide a recording medium between the developer mount member and the door portion along a delivery direction of the recording medium.

In yet another embodiment, the image forming apparatus may further include a door portion to open and close the opening of the main body and including the output contact member disposed on an inner part thereof such that when the developer mount member becomes fully mounted within the main body and the door portion closes, the intermediate contact member and the output contact member make an electrical contact.

In an embodiment, intermediate contact member may include a first contact member disposed on the front end of the developer mount member to directly contact the output contact member when the developer mount member is mounted; and a second contact member having a first end connected to the first contact member and a second end connected to the input contact members to transmit bias voltages from the first contact member to the input contact members.

BRIEF DESCRIPTION OF THE DRAWINGS

The above and other features and utilities of the present inventive concept will become more apparent by describing in detail exemplary embodiments thereof with reference to the attached drawings in which.

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
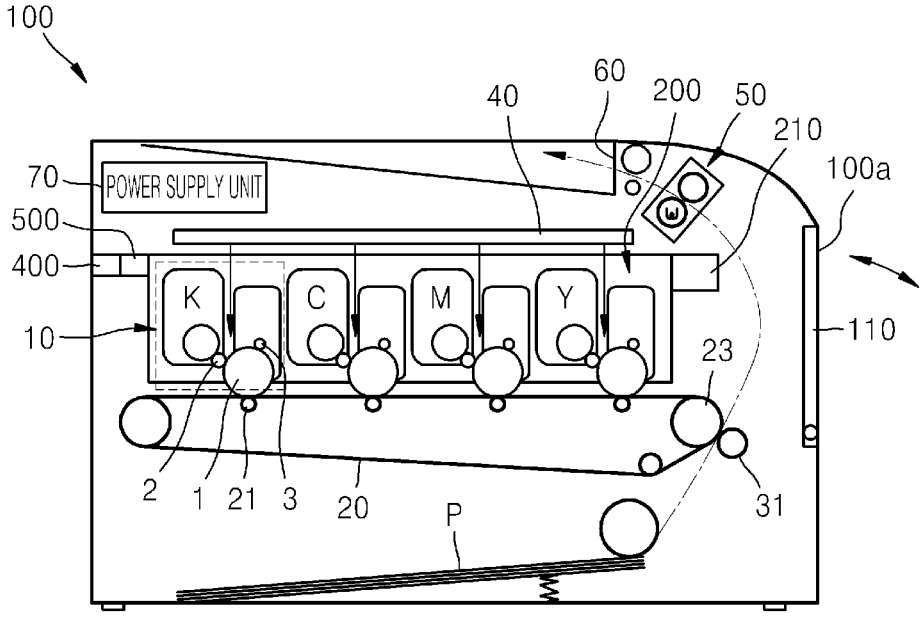
FIG. 1 is a cross-sectional view illustrating an image forming apparatus according to an embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

An image forming apparatus will be briefly explained first.

An image forming apparatus, particularly, an electrophotographic image forming apparatus, forms an electrostatic latent image on a surface of a photosensitive drum by emitting light modulated to correspond to image information to the photosensitive drum, develops the electrostatic latent image into a visible toner image by supplying toner to the electrostatic latent image, and prints an image on a recording medium by transferring and fixing the toner image to the recording medium.

An image forming apparatus of any embodiment of the present inventive concept is a single pass color image forming apparatus using toner of cyan (C), magenta (M), yellow (Y), and black (K) colors. However, the embodiment is not limited thereto, and if necessary, toner of other various colors, such as light magenta and white, may be further used.

FIG. 1 is a cross-sectional view illustrating an image forming apparatus according to an embodiment of the present inventive concept.

Referring to FIG. 1, a recording medium P moves in a C-shape path. The image forming apparatus may include four developers 10, an intermediate transfer belt 20, an exposure unit 40, four intermediate transfer rollers 21, a final transfer roller 31, and a fuser 50.

The intermediate transfer belt 20, which is an intermediate transfer medium to temporarily transfer a toner image before the toner image is finally transferred to the recording medium P, is supported by support rollers 23 and circulates. Each of the developers 10, which form the toner image by attaching toner contained in the developers 10 to an electrostatic latent image formed on photosensitive drums 1, may include a developing roller 2 to supply the toner contained in the developers 10 to the electrostatic latent image formed on the photosensitive drums 1 and a charging roller 3 to charge surfaces of the photosensitive drums 1 to a uniform potential. A developing bias voltage to supply the toner to the electrostatic latent image is applied to the developing roller 2, and a charging bias voltage is applied to the charging roller 3. A corona charger may be used instead of the charging roller 3. The photosensitive drums 1 are photosensitive members on which the electrostatic latent image is formed. The photosensitive drums 1 may be formed by forming a photosensitive layer having photo conductivity on an outer circumferential surface of a cylindrical metal pipe. The four photosensitive drums 1 may contact a top surface of the intermediate transfer belt 20.

The intermediate transfer rollers 21 are intermediate transfer members to transfer the toner image formed on the photosensitive drums 1 to the intermediate transfer belt 20. The four intermediate transfer rollers 21 face the four photosensitive drums 1 with the intermediate transfer belt 20 therebetween. An intermediate transfer bias voltage to transfer the toner image formed on the photosensitive drums 1 to the intermediate transfer belt 20 is applied to the intermediate transfer rollers 21.

The exposure unit 40 forms the electrostatic latent image by emitting light modulated to correspond to image information to the photosensitive drums 1. The exposure unit 40 may be a light-emitting diode (LED) exposure unit that includes a plurality of LEDs arranged in a main scanning direction and allows the LEDs to selectively emit light according to the image information. Alternatively, the exposure unit 40 may be a laser scanning unit (LSU) that deflects light emitted from a laser diode to a main scanning direction by using an optical deflector and scans the light onto the photosensitive drums 1.

The final transfer roller 31 is a final transfer unit to transfer the toner image from the intermediate transfer belt 20 to the recording medium P. A final transfer bias voltage to transfer the toner image on the intermediate transfer belt 20 to the recording medium P may be applied to the final transfer roller 31. A corona transfer unit may be used instead of the final transfer roller 31. The fuser 20 fixes the toner image transferred to the recording medium P by applying heat and pressure. A power supply unit 70 supplies the charging bias voltage, the developing bias voltage, the intermediate transfer bias voltage, and the final transfer bias voltage.

A discharge unit 60 discharges the recording medium P which passes through the fuser 50 and has a printed image from a main body 100 of the image forming apparatus.

Figure 2:
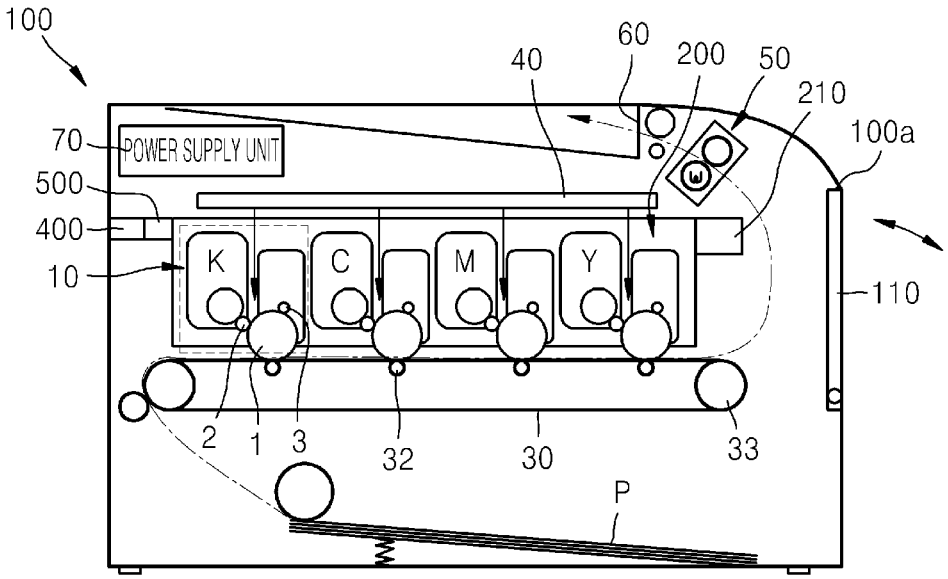
FIG. 2 is a cross-sectional view illustrating an image forming apparatus according to another embodiment of the present inventive concept.

FIG. 2 is a cross-sectional view illustrating an image forming apparatus according to another embodiment of the present inventive concept.

Referring to FIG. 2, the recording medium P moves in an S-shape path. The image forming apparatus includes the four developers 10, a transfer belt 30, the exposure unit 40, the four photosensitive drums 1, four transfer rollers 32, and the fuser 50.

The transfer belt 30, which is a medium to directly deliver the recording medium P, is supported by support rollers 33 and circulates.

The transfer rollers 32 are transfer units to transfer the toner image formed on the photosensitive drums 1 to the recording medium P delivered by the transfer belt 30. The four transfer rollers 32 face the four photosensitive drums 1 with the recording medium P therebetween. A transfer bias voltage to transfer the toner image formed on the photosensitive drums 1 to the recording medium P is applied to the transfer rollers 32.

Other elements are the same as those of the image forming apparatus of FIG. 1 and are denoted by the same reference numerals, and thus, a detailed explanation thereof is omitted.

Since the plurality of developers 10 are mounted on a developer mount member 200, the plurality of developers 10 in the image forming apparatus of FIG. 1 or 2 may be replaced at one time by mounting or withdrawing the developer mount member 200 on or from the main body 100. In this configuration, the developers 10 may be more easily replaced and repaired, and bias voltages may be stably supplied to the rollers of the developers 10.

A process of replacing the developers 10 by mounting or withdrawing the developer mount member 200 on or from the main body 100 will be explained.

Figure 3:
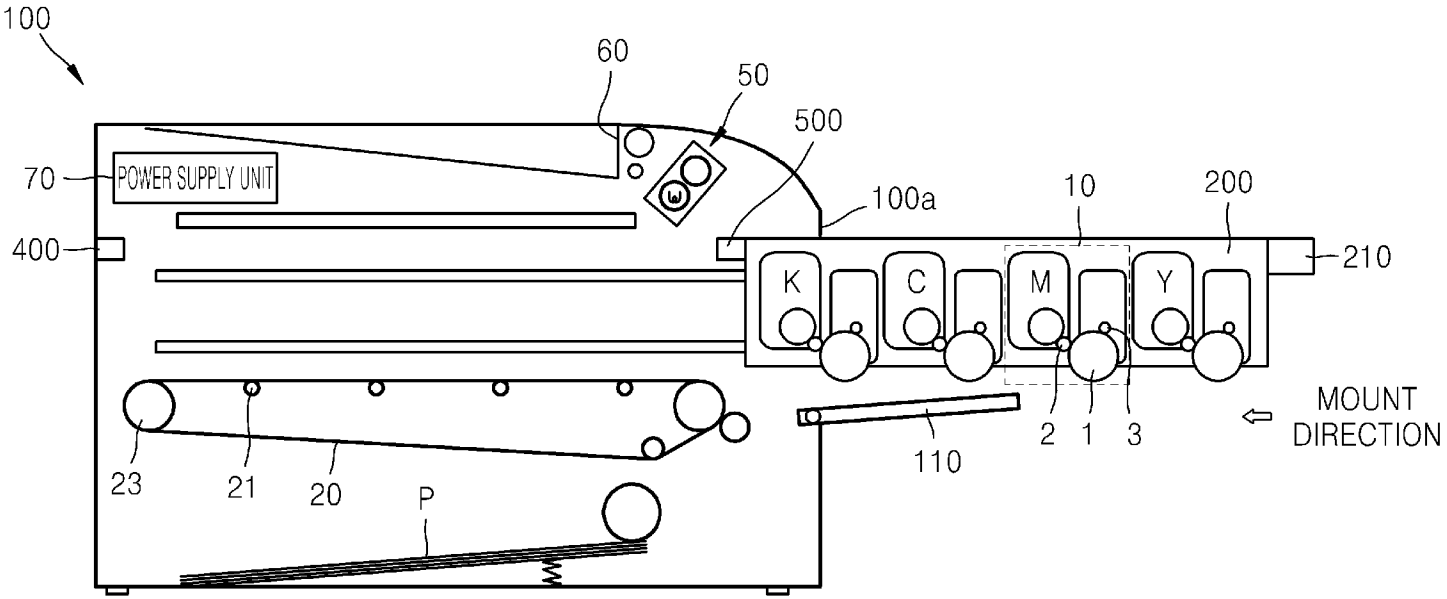
FIG. 3 is a cross-sectional view illustrating a state before a developer mount member of the image forming apparatus of FIG. 1 is mounted.

FIG. 3 is a cross-sectional view illustrating a state before the developer mount member 200 of the image forming apparatus of FIG. 1 is mounted. Referring to FIG. 3, the plurality of developers 10 may be mounted on the developer mount member 200, and the developer mount member 200 may be slidably coupled to the main body 100. In this case, in order for a user to easily withdraw the developer mount member 200 from the main body 100, a handle 210 may be formed on an end portion of the developer mount member 200. Since the plurality of developers 10 may be coupled to or separated from the main body 100 as the developer mount member 200 is mounted on or withdrawn from the main body 100, the user may easily replace the plurality of developers 10 at one time.

A process of replacing the plurality of developers 10 will be explained briefly. In order to replace the plurality of developers 10, a door portion 110 of the main body 100 can be opened and the developer mount member 200 is then withdrawn through an opening 100*a* formed in the main body 100.

One of the developers 10, which needs to be replaced, is removed from the developer mount member 200, and then a new developer is attached to the developer mount member 200. The developer mount member 200, to which the new developer is attached, is mounted on the main body 100 by being inserted through the opening 100*a*, and then the door portion 110 can be closed, thereby completing the replacing of the used up or damaged developer with the new developer.

Another developer of the image forming apparatus of FIG. 2, which needs to be replaced, may be replaced with a new developer by using the same process as explained with reference to FIG. 3.

For the image forming apparatus, including the developers 10 which are easily replaced, print quality may vary according to electrical connection between the developers 10 and the main body 100. Accordingly, electrical connection between the developers 10 and the main body 100 will be explained now in detail.

Figure 4:
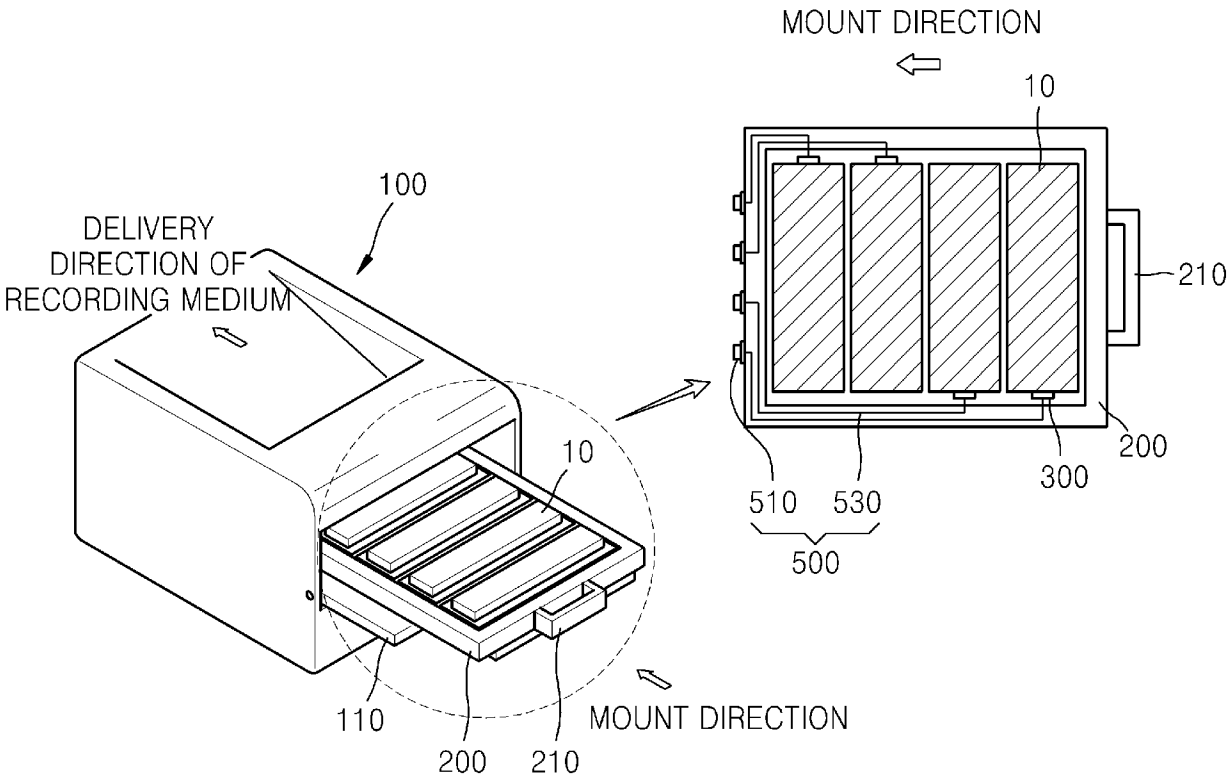
FIGS. 4 through 6 are plan views illustrating electrical connection relationships of the image forming apparatus of FIG. 1.
Figure 5:
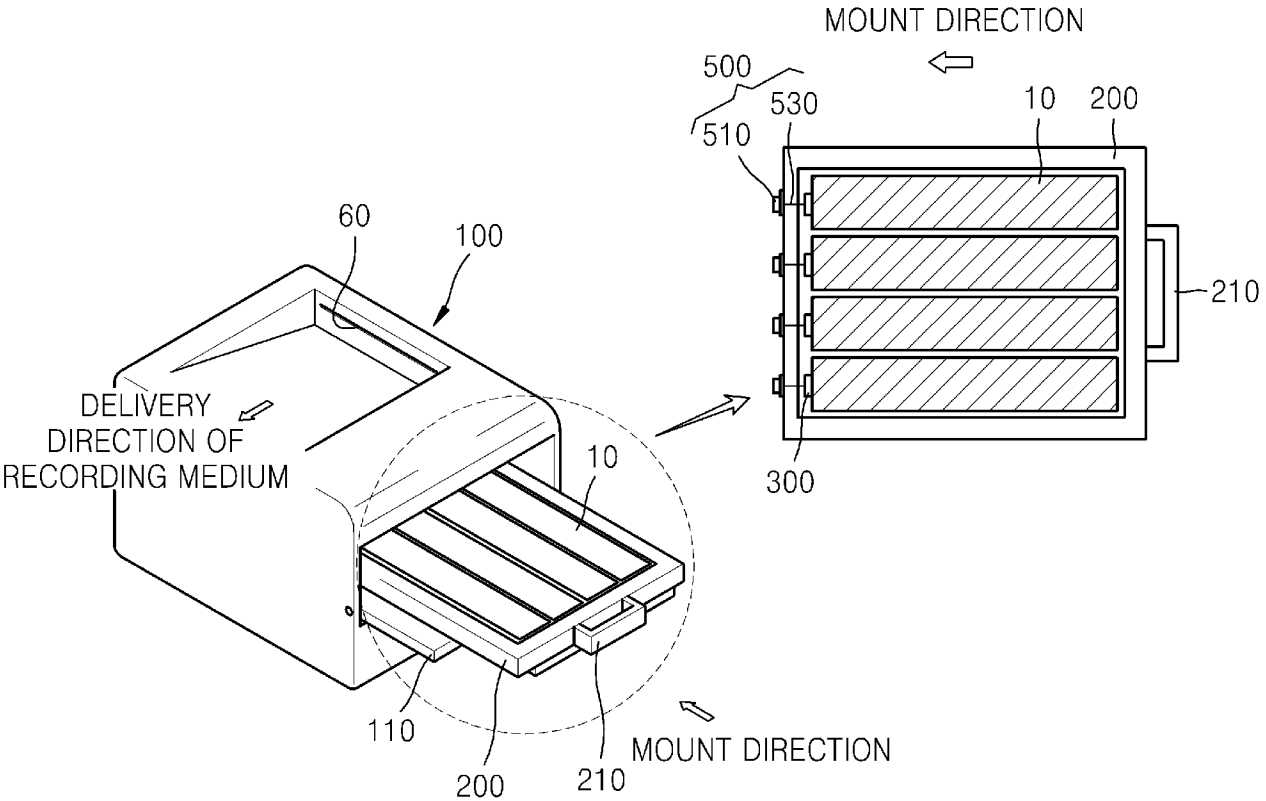
Figure 6:
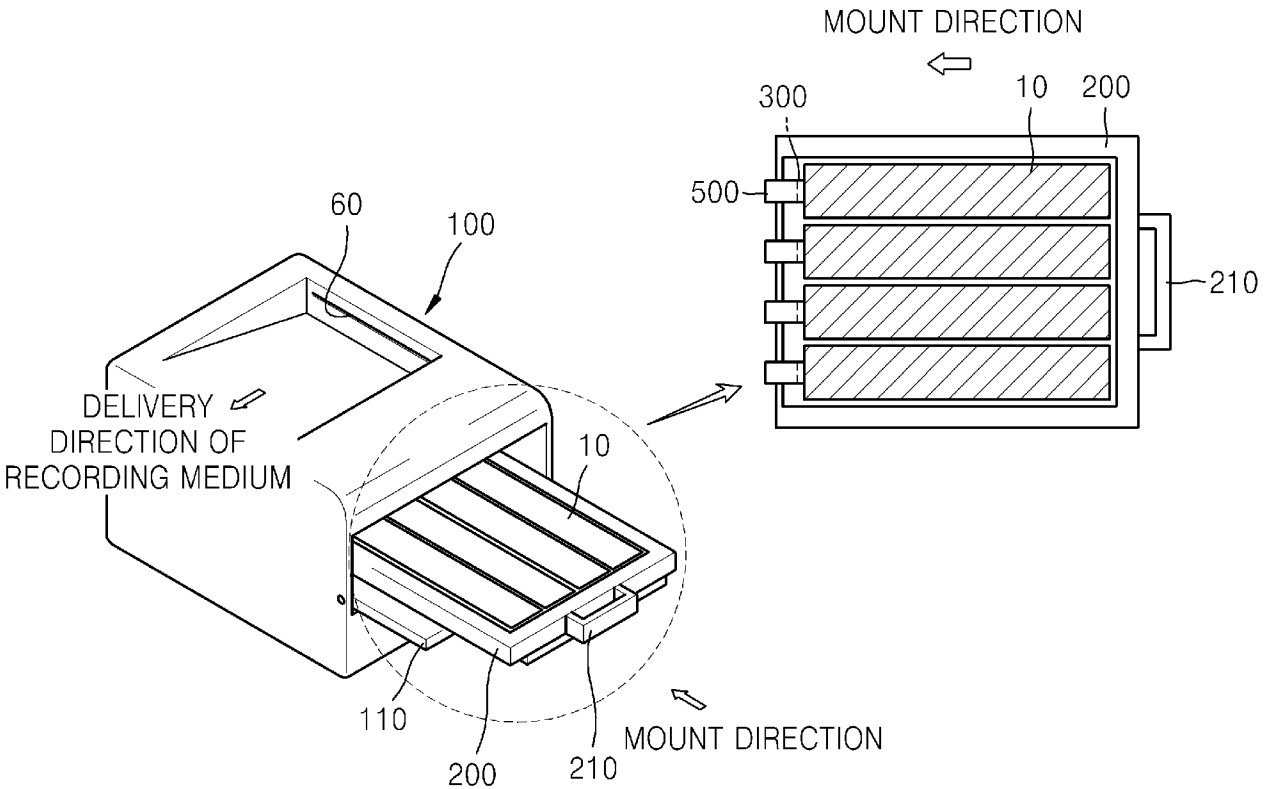

FIGS. 4 through 6 are plan views illustrating various electrical connection relationships of the image forming apparatus of FIG. 1.

Referring to FIGS. 1, 3 and 4, for electrical connection, input contact members 300, output contact members 400, and intermediate contact members 500 are provided.

The input contact members 300 are formed at at least one side of the developers 10 in order to enable bias voltages to be applied the developers 10. Although not shown clearly in FIGS. 3 and 4, a plurality of input contact members 300 may be formed in addition to those formed in FIG. 5. For example, the input contact members 300 may also be end portions of the developing rollers 2 and the charging rollers 3 of the developers 10 which receive bias voltages, that is, end portions of rotational shafts of the developing rollers 2 and the charging rollers 3. Although not shown in FIGS. 3 and 4, the input contact members 300 may be conductive members electrically connected to the end portions of the rotational shafts of the developing rollers 2 and the charging rollers 3.

The output contact members 400 are provided in the main body 100 and receive a bias voltage from the power supply unit 70. The output contact members 400 may be disposed in the main body to face a front end of the developer mount member 200 in a mount direction in which the developer mount member 200 is mounted. Since the output contact members 400 are disposed to face a front end of the developer mount member 200 in the mount direction of the developer mount member 200, the output contact members 400 are not affected by a movement of the developer mount member 200 when the developer mount member 200 is mounted or withdrawn. Accordingly, damage to the output contact members 400 or the intermediate contact members 500, which may occur when the developer mount member 200 moves, may be prevented. Also, since an additional element such as a link member to extricate the output contact members 400 from the movement of the developer mount member 200 is not required, the number of parts may be reduced remarkably.

The intermediate contact members 500 are disposed on the developer mount member 200. The intermediate contact members 500 are electrically connected to the input contact members 300 disposed on the developers 10. The intermediate contact members 500 are electrically connected to the output contact members 400 provided in the main body 100 when the developer mount member 200 is mounted on the main body 100. Accordingly, the input contact members 300 and the output contact members 400 may be electrically connected to each other, and a bias voltage may be transmitted from the output contact members 400 to the input contact members 300. The intermediate contact members 500 may be formed of a conductive metal material. For example, the intermediate contact members 500 may be formed of copper, aluminium, tin, platinum, or the like.

The intermediate contact members 500 may be disposed on a front end of the developer mount member 200 in the mount direction. Accordingly, when the developer mount member 200 is mounted on the main body 100, the intermediate contact members 500 disposed on the front end of the developer mount member 200 are stably electrically connected to the output contact members 400 that are disposed in the main body to face a front end of the developer mount member 200 in the mount direction due to a force applied to mount the developer mount member 200 on the main body 100 without using an additional connection medium to connect the intermediate contact members 500 to the output contact members 400. The intermediate contact members 500 may be formed of an elastic material in order to apply a pressure force when the developer mount member 200 is mounted. Examples of the elastic material may include a leaf spring type metal material and a coil spring type metal material.

For example, the intermediate contact members 500 may include first contact members 510 and second contact members 530. The same applies even when the mount direction of the developer mount member 200 is parallel to a delivery direction in which the recording medium P is delivered, as shown in FIG. 4, and also when the mount direction of the developer mount member 200 intersects, for example, perpendicularly intersects, the delivery direction of the recording medium P, as shown in FIG. 5. The first contact members 510 are disposed on the front end of the developer mount member 200, and directly contact the output contact members 400 when the developer mount member 200 is mounted. First ends of the second contact members 530 are connected to the first contact members 510 and second ends of the second contact members 530 are connected to the input contact members 300 to transmit bias voltages from the first contact members 510 to the input contact members 300. Since the first contact members 510 are electrically connected to the input contact members 300 through the second contact members 530, positions and intervals of the first contact members 510 may be freely designed. Accordingly, since positions and intervals of the output contact members 400 disposed to contact the first contact members 510 are freely designed according to the first contact members 510, areas occupied by the output contact members 400 in the main body 100 may be reduced and various design changes may be easily made. In order to apply a pressure force when the developer mount member 200 is mounted, the first contact members 510 may be formed of an elastic material. Examples of the elastic material may include a leaf spring type metal material and a coil spring type metal material.

Alternatively, the intermediate contact members 500 may be integrally formed with the input contact members 300, as shown in FIG. 6. To integrally form the intermediate contact members 500 with the input contact members 300, the developers 10 are preferably disposed in a direction parallel to the mount direction of the developer mount member 200. Since the developers 10 are disposed in the direction parallel to the mount direction in this case, damage to the intermediate contact members 500 integrally formed with the input contact members 300 when the developer mount member 200 is mounted or withdrawn may be avoided.

Figure 7:
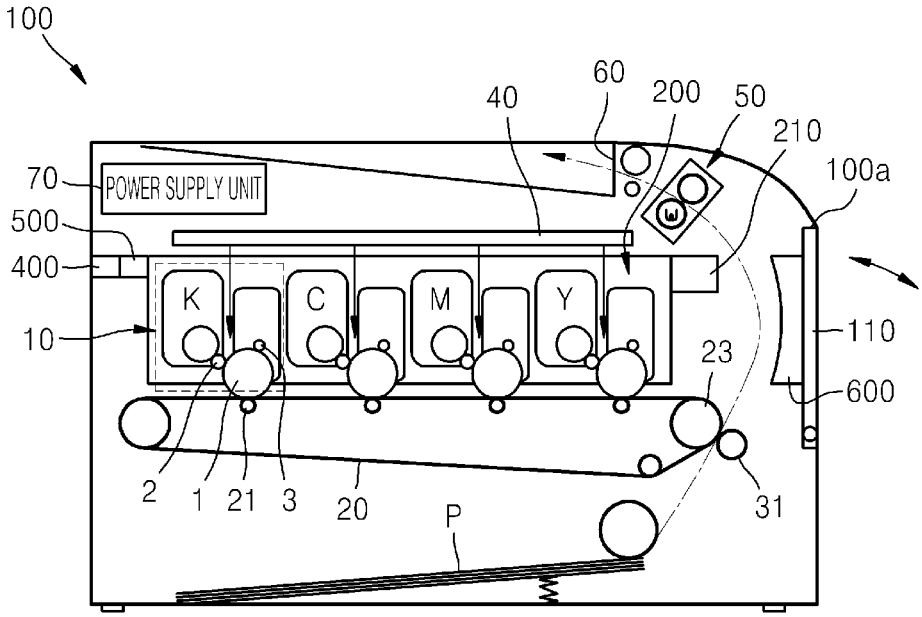
FIG. 7 is a cross-sectional view illustrating an image forming apparatus further including a guide member, according to another embodiment of the present inventive concept.

FIG. 7 is a cross-sectional view illustrating an image forming apparatus according to another embodiment. Referring to FIG. 7, the image forming apparatus may further include a guide member 600. The recording medium P passes between the door portion 110 of the main body 100 and the developer mount member 200 and then is discharged through the discharge unit 60 as described above with reference to FIGS. 1 and 2. In this case, since the image forming apparatus further includes the guide member 600, as shown in FIG. 7, which guides the recording medium P passing between the developer mount member 200 and the door portion 110, the recording medium P discharged through the discharge unit 60 may smoothly move through the main body 100 and can be prevented from being jammed.

The guide member 600 may be disposed on the door portion 110 of the main body 100 and thus may move as the door portion 110 opens or closes. Accordingly, the guide member 600 does not obstruct the developer mount member 200 from being mounted or withdrawn and may smoothly guide the recording medium P through the discharge unit 60. In order to smoothly deliver the recording medium P, a surface of the guide member 600 facing the recording medium P may have a shape conforming to a delivery path of the recording medium P.

Figure 8:
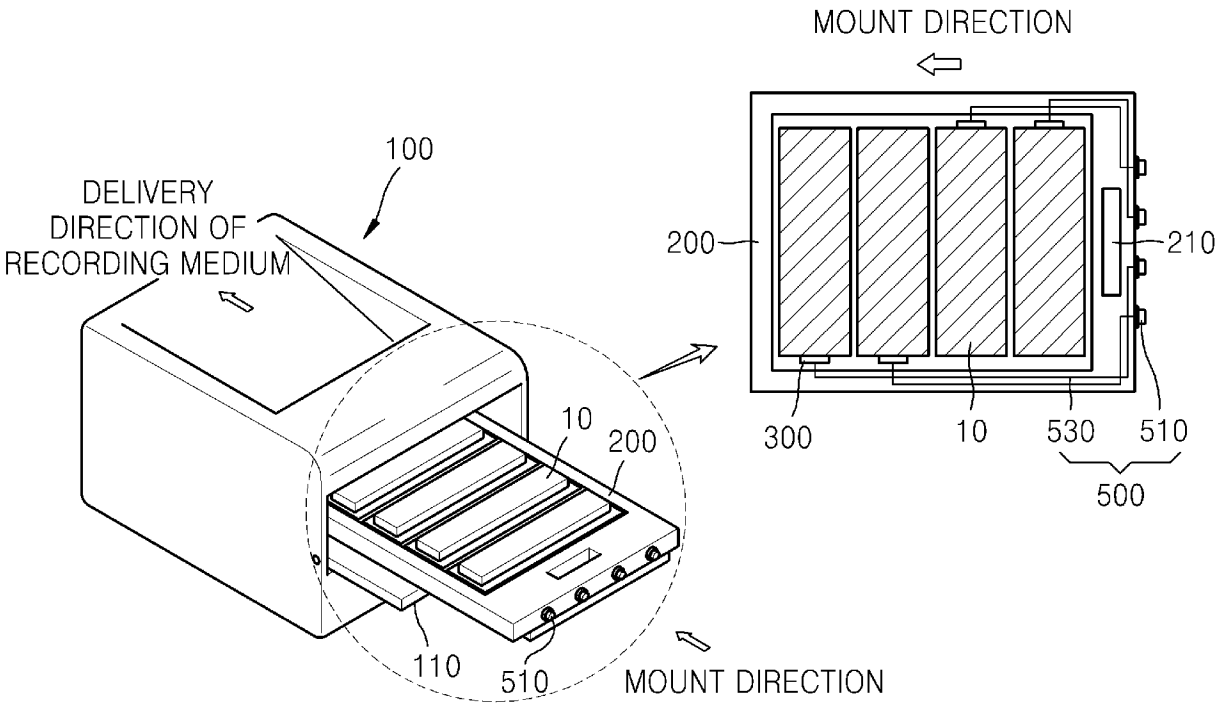
FIGS. 8 through 10 are plan views illustrating alternative electrical connection relationships of the image forming apparatus of FIG. 11.
Figure 9:
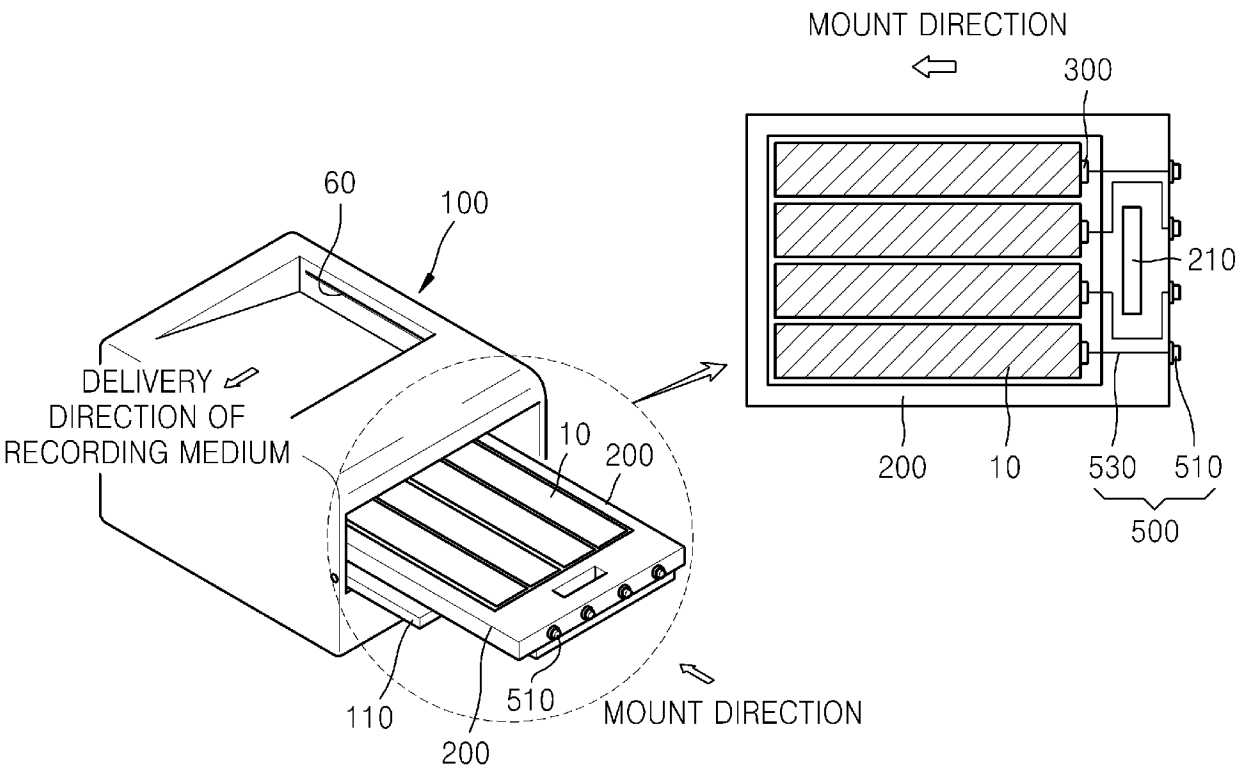
Figure 10:
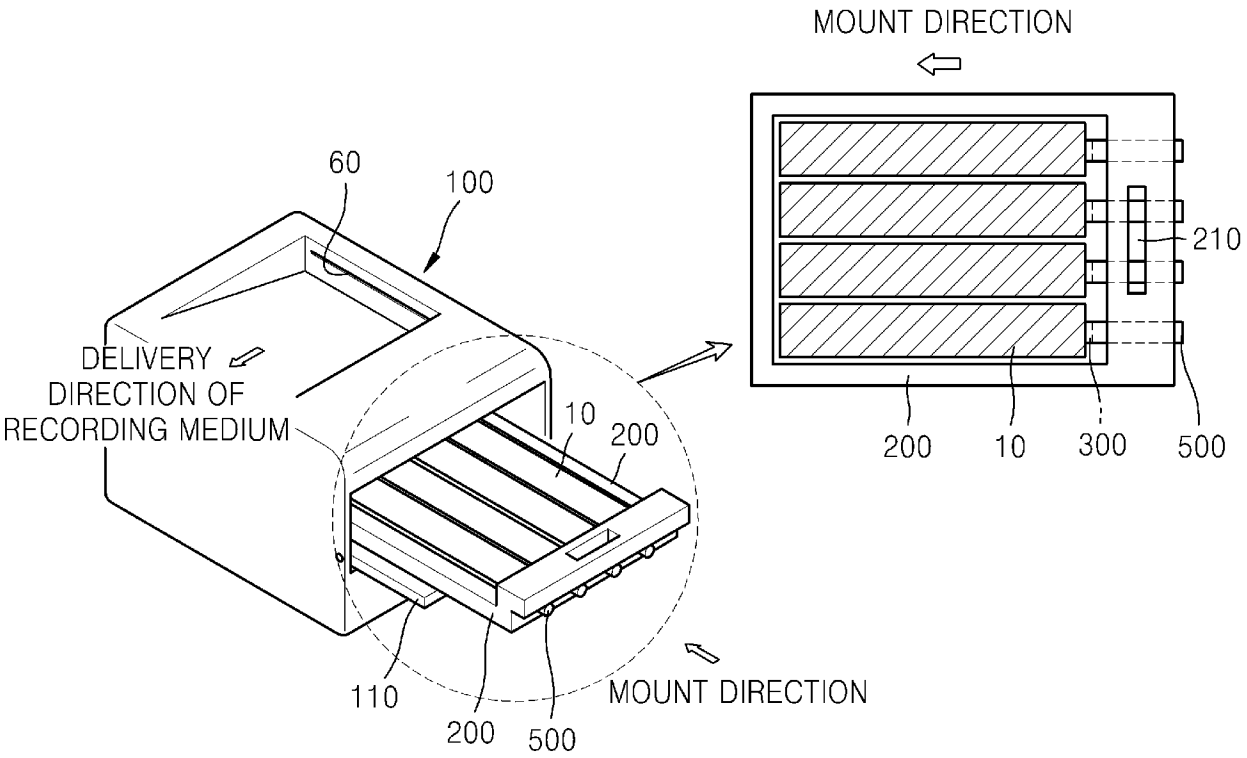

FIGS. 8 through 10 are plan views illustrating alternative designs of the developer mount member 200, the input contact members 300, and the intermediate contact members 500 of another exemplary embodiment of the image forming apparatus of FIG. 11, which will be described below.

Figure 11:
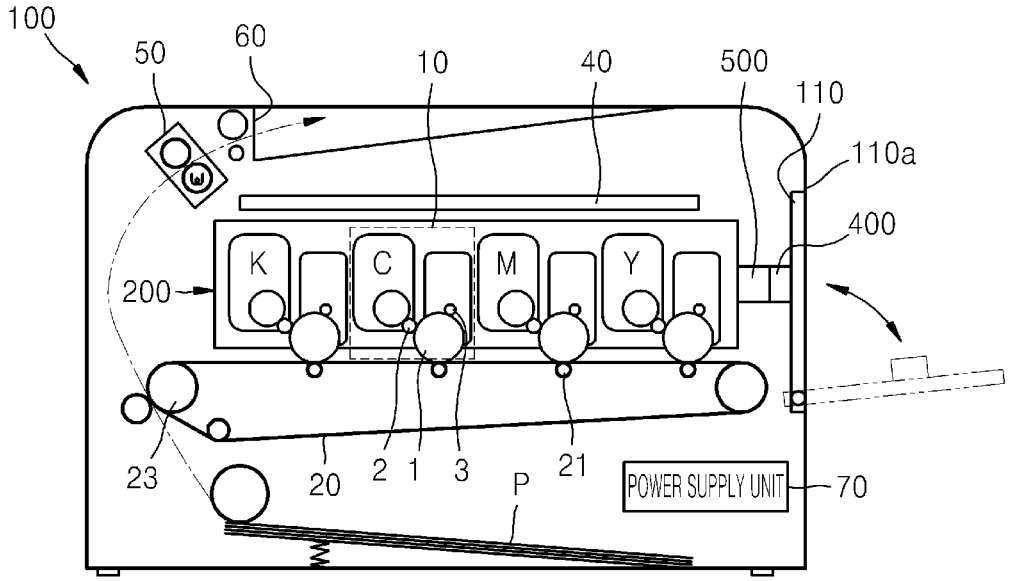
FIG. 11 is a cross-sectional view illustrating yet another embodiment where output contact members and intermediate contact members contact each other.

FIG. 11 is a cross-sectional view illustrating a state where the output contact members 400 and the intermediate contact members 500 contact each other according to another exemplary embodiment of the image forming apparatus of FIG. 11. The same elements as those in the previous embodiments are denoted by the same reference numerals and a repeated explanation thereof is omitted.

In the present embodiment of FIG. 11, and corresponding alternative designs illustrated in FIGS. 8-10, the output contact members 400 are disposed to face a rear end of the developer mount member 200 in a mount direction in which the developer mount member 200 is mounted. In other words, the output contact members 400 may be disposed to face an end of the developer mount member 200 that leads the remaining portions of the developer mount member 200 in a withdrawal direction in which the developer mount member 200 is withdrawn. The withdrawal direction is a direction opposite to the mount direction. The same applies when the mount direction of the developer mount member 200 is parallel to the delivery direction of the recording medium P, as shown in FIG. 8, and also when the mount direction of the developer mount member 200 is perpendicular to the delivery direction of the recording medium P, as shown in FIGS. 9 and 10. As illustrated in FIG. 1, the output contact members 400 may be disposed on the door portion 110 that opens or closes the opening 100*a* through which the developer mount member 200 enters or exits. Since the output contact members 400 are disposed on the door portion 110 and thus move as the door portion 110 opens or closes, the output contact members 400 are not affected by a movement of the developer mount member 200 when the developer mount member 200 is mounted or withdrawn. Accordingly, damage to the output contact members 400 or the intermediate contact members 500, which may occur when the developer mount member 200 moves to contact the output contact members 400, may be prevented. Also, since an additional element, such as a link member to extricate the output contact members 400 from the movement of the developer mount member 200, is not required, the number of parts may be reduced remarkably.

The intermediate contact members 500 may be disposed at a rear end of the developer mount member 200 in the mount direction. When the developer mount member 200 is mounted on the main body 100 and the door portion 110 closes, the intermediate contact members 500 disposed at the rear end of the developer mount member 200 may be stably electrically connected to the output contact members 400 disposed on the door portion 110 to face a rear end of the developer mount member 200 in the mount direction due to a force to close the door portion 110 without using an additional connection medium.

For example, the intermediate contact members 500 may include first contact members 510 and second contact members 530. The first contact members 510 are disposed at the rear end of the develop mount member 200 in the mount direction, and directly contact the output contact members 400 when the developer mount member 200 is mounted and then the door portion 110 closes. First ends of the second contact members 530 are connected to the first contact members 510 and second ends of the second contact members 530 are connected to the input contact members 300 to transmit bias voltages from the first contact members 510 to the input contact members 300. Since the first contact members 510 are electrically connected to the input contact members 300 through the second contact members 530, positions and intervals of the first contact members 510 may be freely designed. Accordingly, since positions and intervals of the output contact members 400 disposed to contact the first contact members 510 are freely designed according to the first contact members 510, areas occupied by the output contact members 400 on the door portion 110 may be reduced and various design changes may be easily made.

Alternatively, the intermediate contact members 500 may be integrally formed with the input contact members 300, as shown in FIG. 10. To integrally form the intermediate contact members 500 with the input contact members 300, the developers 10 are preferably disposed in a direction parallel to the mount direction of the developer mount member 200. In this case, a position of the handle 210 may be determined such that the handle 210 does not affect positions of the intermediate contact members 500. However, the present embodiment is not limited thereto, and if necessary, the handle 210 may not be provided. Since the developers 10 in FIG. 10 are disposed in the direction parallel to the mount direction, damage to the intermediate contact members 500 integrally formed with the input contact members 300 when the developer mount member 200 is mounted or withdrawn may be avoided.

An image forming apparatus according to the various exemplary embodiments have the following effects.

First, since an electrical contact structure is disposed in a withdrawal or a mount direction of a developer mount member, the reliability of electrical contact may be improved by simply mounting the developer mount member.

Second, since an additional pressure member or interlocking member for electrical contact is not required, the number of parts may be reduced or eliminated, and thus manufacturing costs may be reduced. Also, since an additional interlocking member is not required, a force needed to open or close a door portion may be reduced, thereby improving user convenience as well as longevity of the overall parts of the image forming apparatus.

Third, since the electrical contact structure is simple, the electrical contact structure may be applied to various delivery paths of a recording medium.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus in which developers are detachably coupled to a main body, the image forming apparatus comprising:

a developer mount member on which the developers are mounted and that is attachable to and detachable from the main body;

an input contact member disposed on each of the developers;

a power supply unit provided in the main body;

an output contact member disposed in the main body to face a front end of the developer mount member in a mount direction in which the developer mount member is mounted and is electrically connected to the power supply; and an intermediate contact member is disposed on the front end of the developer mount member in the mount direction and is electrically connected to a respective one of the input contact members, the intermediate contact member being elastically deformed to apply a pressure force when the developer mount member is mounted, and to electrically contact the output contact member as the developer mount member is mounted in the main body.

2. The image forming apparatus of claim 1, wherein each intermediate contact member comprises:

a first contact member that is disposed on the front end of the developer mount member in the mount direction and directly contacts the output contact member when the developer mount member is mounted on the main body; and a second contact member that electrically connects the first contact member and the respective input contact member.

3. The image forming apparatus of claim 2, wherein the mount direction is parallel to a delivery direction of a recording medium within the main body.

4. The image forming apparatus of claim 2, wherein the first contact member comprises the elastic material.

5. The image forming apparatus of claim 3, wherein each input contact member is disposed at a side of the respective developer that is disposed in a direction intersecting the mount direction.

6. The image forming apparatus of any one of claim 1, further comprising:

a door portion disposed on the main body to open and close an opening through which the developer mount member enters and exits.

7. The image forming apparatus of claim 1, wherein the elastic material of the intermediate contact member includes one or more of a leaf spring type metal material and a coil spring type metal material.

8. An image forming apparatus in which developers are detachably coupled to a main body, the image forming apparatus comprising:

a developer mount member on which the developers are mounted and that is attachable to and detachable from the main body;

an input contact member disposed on each of the developers;

a power supply unit provided in the main body;

an output contact member disposed in the main body to face a front end of the developer mount member in a mount direction in which the developer mount member is mounted and is electrically connected to the power supply;

an intermediate contact member disposed on the front end of the developer mount member in the mount direction and is electrically connected to a respective one of the input contact members, and electrically contacts the output contact member as the developer mount member is mounted in the main body;

a door portion disposed on the main body to open and close an opening through which the developer mount member enters and exits; and a guide member that guides a recording medium passing between the door portion and the developer mount member.

9. The image forming apparatus of claim 8, wherein the guide member is disposed on an interior of the door portion to guide a recording medium along a recording medium delivery path between the developer mount member and the door portion.

* * * * *

UNITED STATES PATENT AND TRADEMARK OFFICE

CERTIFICATE OF CORRECTION

PATENT NO. : 9,188,944 B2
APPLICATION NO. : 13/564988
DATED : November 17, 2015
INVENTOR(S) : Jeong-yeon Park et al.

It is certified that error appears in the above-identified patent and that said Letters Patent is hereby corrected as shown below:

IN THE CLAIMS

Claim 6, Column 12, Line 1

After “apparatus of” delete “any one of”.

Signed and Sealed this
Ninth Day of February, 2016

Michelle K. Lee

Michelle K. Lee
*Director of the United States Patent and Trademark Office*